US008534582B2

(12) United States Patent
Diekman

(10) Patent No.: US 8,534,582 B2
(45) Date of Patent: Sep. 17, 2013

(54) WOUND ROPE OR CORD SUPPORT

(76) Inventor: Douglas Jerome Diekman, Byron Center, MI (US)

( * ) Notice: Subject to any disclaimer, the term of this patent is extended or adjusted under 35 U.S.C. 154(b) by 370 days.

(21) Appl. No.: 12/932,471

(22) Filed: Feb. 25, 2011

(65) Prior Publication Data

US 2012/0217335 A1 Aug. 30, 2012

(51) Int. Cl.
*B65H 55/04* (2006.01)

(52) U.S. Cl.
USPC ..... 242/174; 242/405.2; 242/587.2; 242/588.2; 242/613.3; 242/118; 242/125.1; 242/129; 242/901

(58) Field of Classification Search
USPC ... 242/172, 174, 388, 388.1, 402, 405–405.3, 242/472.3, 472.5, 579, 587–587.2, 588, 588.2, 242/600, 613–613.3, 118, 125–125.1, 127, 242/129, 901, 407; 223/85–98
See application file for complete search history.

(56) References Cited

U.S. PATENT DOCUMENTS

| | | | |
|---|---|---|---|
| 1,728,106 | A | 9/1929 | Albert |
| 2,465,001 | A | 3/1949 | Walker |
| 2,677,510 | A | 5/1954 | Osborne |
| 3,574,900 | A | 4/1971 | Emery |
| 4,123,012 | A | 10/1978 | Hough |
| 4,277,035 | A | 7/1981 | Gaski |
| 4,361,938 | A | 12/1982 | Emery |
| 4,586,675 | A | 5/1986 | Brown |
| 4,687,154 | A | 8/1987 | Deweese |
| 4,779,817 | A | 10/1988 | Bjork |
| 5,348,240 | A | 9/1994 | Carmo et al. |
| 5,924,643 | A | 7/1999 | Campana |
| 5,938,134 | A | 8/1999 | Shields et al. |
| 7,455,258 | B2 | 11/2008 | Proebstle |

FOREIGN PATENT DOCUMENTS

| | | | |
|---|---|---|---|
| EP | 520366 | A1 | 12/1992 |
| JP | 2006222712 | A | 8/2006 |

OTHER PUBLICATIONS

Kite String in Toys & Hobbies, Clothing, Shoes & Accessories on eBay 100M Dyneema Strong Stringline 500lbs, p. 5 of 6 Sep. 2010.

*Primary Examiner* — William E Dondero
(74) *Attorney, Agent, or Firm* — Joseph K. Andonian

(57) ABSTRACT

A support comprising a handhold in the center with two ends extending straight out in opposite directions away from the handhold for winding and storing a rope or cord in a secure condition in a figure-8 configuration around the ends of the support using a flexible tie affixed at one end to the center of the support to wrap around and secure the rope or cord to the support when the other end of the tie is fastened to a cleat located in the center of the support. A method of winding and releasing a line on the support.

16 Claims, 8 Drawing Sheets

A-A
B-B
C-C
1
2
3
4a
4b
5
6a
6b
6c
6d
7
11
12
13
16
17
18
19
20
21
24

WOUND ROPE OR CORD SUPPORT

This invention relates to a support and method especially adapted for winding, holding, storing and releasing a rope or cord in a tangle free condition.

BACKGROUND OF INVENTION

Ropes or cords have many uses but reuse presents a problem because they are prone to tangling after they are unwound from their original packaging, stretched out and used. When prepared for storage after first use, it is commonplace for the individual user to hold one end of the cord or rope in one hand, wind it around his elbow and back over his hand in continuous loops and then store it in that condition after separation from the forearm. When reused after storage in the described condition the rope or cord requires careful effort to avoid tangling and knotting when the cord is unwound to its full length.

An extreme example of tangling occurs when attempting to reuse a string of Christmas lights after storage. The uneven surface provided by the lights that protrude from the cord increases tangling enough so that some users simple throw the Christmas lights away after one use rather than attempt to untangle them when attempting reuse after storage.

Figure-8 configurations for winding a string or line over a piece of wood held in the hand have been utilized for many years by kite flyers and construction workers. It was eventually realized that, if a rope or cord is wound in a figure-8 configuration and subsequently released all at once, it will unwind without tangles. U.S. Pat. Nos. 4,586,675 and 7,455,258 provide examples of supports or holders designed to take advantage of this configuration to wind, store and release cords and ropes. U.S. Pat. No. 5,924,643 discloses winding and storing lines in a figure-8 configuration on a holder that is not suitable for releasing the line quickly in a tangle free condition.

The present invention accomplishes the same results as these combined teachings to wind ropes or cords around a support quickly and easily in a figure-8 configuration, store them securely in that condition and take advantage of the tangle and knot free release when reused, all in a significantly simpler, more convenient and more economical manner.

BRIEF SUMMARY OF INVENTION

Disclosure of Invention

The present invention most broadly comprises a support or holder that resembles a stick having a handhold in the center, two ends extending straight out in opposite directions from the handhold, an elongate flexible tie with one end fixedly attached to the center and means also located in the center for fastening the free end of the tie. Means for hanging the support for storage can be provided at one end of the support. When used the support is held in the center with one hand, a line (e.g., a rope or cord) is wound around the ends with the free hand in a figure-8 configuration. Continuing with the free hand, the tie is wound around the center of the figure-8 and the support and then fitted into the fastening means. To release the line for reuse, one end of the support (preferably the hanging end if hanging means are present) is held with one hand and the other hand is used to free the tie from the fastening means, unwind and drop the free end of the tie. The free hand then engages the line and together the hands move the line off the free end of the support through the openings in the figure-8 allowing the line to fall down in a knot and tangle free condition ready for reuse.

For convenience the word "line" will be used throughout this specification to signify an elongate flexible object that is suitable for winding around a support in a figure-8 configuration. A "rope" or "cord" is an obvious example of such an elongate object. Twine and string are other examples. Garlands, like those used to decorate Christmas trees, are still other examples. Hoses like those commonly used for gardening, especially those that collapse and flatten when not in use, are other examples. Welding hoses are other examples.

Thus while holding the stick like support in the center section in one hand, a line can be wound in a figure-8 configuration around the ends of the support with the other hand. No arms protruding from a stick are required such as those depicted in U.S. Pat. Nos. 4,586,675 and 7,455,258. Instead of using arms to secure the line to the support such as those described in the aforesaid patents, a flexible tie attached at one end to the center of the support can be wound around the line attached to the support and secured at the other end to a fastening means (most preferably a V or U-shaped cavity with projections on its inside surfaces) also located in the center of the support. When reused the line can be released in a tangle free condition by holding one end of the support in one hand, releasing the free end of the tie from the fastening means and unwinding the tie with the other hand. Still holding one end of the support with one hand, holding the line with the other hand, pulling the support out through the loops or openings formed by the figure-8 and dropping the line, the line will drop in a knot and tangle free condition.

Although the tie can take the form of a rope or a heavy string, the tie is preferably constructed more like the elastic portion of a bungee cord. When stretched, its circumference is reduced. When relaxed, it returns to its larger size. Thus, when stretched, it will fit easily into a jamming cleat like those described in U.S. Pat. Nos. 4,361,938 and 3,574,900 and this specification. When relaxed, it expands enough to press against the walls of the cavity present in such a cleat and thereby firmly secures a line to the support. When stretched again the tie can easily be released from the cavity. While a rope has the ability to give enough to be stress fitted into such a cavity and maintain its position when relaxed, it tends to wear more when forced into and subsequently released from the cavity than a more elastic cord. Such a cavity is non-directional (i.e., approachable from the front or back of the support) and merely requires force to secure the tie in the cavity.

The tie is affixed at one end (hereinafter the fixed end) to the center section of the support, for example, by threading the other end (hereinafter the free end) through a hole sized at the exit end to accommodate the diameter of the tie and press fitting the fixed end into the entrance portion of the same hole to accommodate the larger size of the fixed end of the tie. Most preferably the fixed end is knotted so it is large enough to resist passage through the exit end of the hole but will fit snugly in the entrance end of the hole. The knotted portion can be held more securely in place by a cover that can also serve as identifying means for the support. Alternatively a ring or cap larger in circumference than the tie can be attached to the fixed end of the tie and stress fitted into the opening.

The cord holder in U.S. Pat. No. 7,455,258 releases the cord by turning an arm down from an upward position to allow the cord to drop off the holder by tilting the holder. Such moveable arms require a more complex construction than the present invention. U.S. Pat. No. 4,586,675 uses a hinge in the center of the holder to turn the otherwise stationary arms in toward the center of the figure-8 formed by a cord wound on the holder so the cord can fall off the holder, again a more complex construction than the present invention to accomplish the same result. The support of the present invention releases a line wound in a figure-8 on the support by holding one end of the support in one hand, placing the other hand on the line, pulling the support and the line apart through the openings in the figure-8 and allowing the line to fall off the support.

The means for fastening the free end of the tie can be molded or cut into the support or added as a separate part, but molding the fastening means into the support is preferred since it is less costly and works well.

For storage purposes, one end of the support is preferably fashioned to provide means for hanging the support. The support is preferably made in one piece from a hard moldable plastic to reduce the cost of manufacture with hanging means (e.g., a hook and/or an eye) at one end and a center section adapted to provide a handhold, means for permanently affixing one end of a tie, and separate means for removably affixing the other end of the tie. The hanging means can be shaped and sized to hang on any system for hanging tools. Slat boards or pegboards are examples of such systems. For mountain climbers a C-clip can be added in place of the hook or eye to allow more secure attachment to the belt of the climber.

One end of a line can be held in the hand holding the center of the support while the other hand winds the line around the ends of the support in a figure-8 configuration. The line itself can have an eye or loop (normally present on ski ropes) in one end adapted to fit over one end of the support to eliminate the need for holding the end of the line in the hand before winding the line around the ends of the support. Alternatively one end of a line can be cinched to one end of the support by wrapping an elastic figure-8 shaped material around the line, passing one end of the figure-8 through the opening at the other end and using the exposed end to fit over the end of the support. More preferably a notch can be cut into the top surface on one side of the support to provide a place where one end of a line with or without a loop can be fitted before winding the line on the support. The notch is preferably U-shaped and slanted so the open end is closer to the end of the support than the closed or bottom end of the notch. The side of the U closest to the end of the support is also curved slightly toward the end of the support as it approaches the top surface of the support so the line can slide off the support without catching on the notch. The notch is preferably located nearer to the center than the end of the support since more space is available for the notch in that location without weakening the support.

Preferably the center of the support can be fashioned into a handhold that includes a fully enclosed opening in the center of the support shaped and sized to allow the fingers of the hand to fit into the opening while the thumb and fingers are wrapped over the top of the support. Such a handhold, sometimes referred to as a grip handle, is commonly used for hand tools such as a saw or a drill. This configuration requires the center of the support to be larger from top to bottom than the two ends. The top surface of the support is preferably rounded in a shallow convex configuration and raised above the level of the ends of the support to provide the space necessary for the opening for the fingers in the handhold. The bottom surface of the support is preferably rounded in a shallow concave configuration. An indentation can be provided on the top surface of the support for the thumb of the hand holding the support to help position the hand in the most favorable and comfortable position on the support. Indentations can also be provided in the top surface of the opening for the fingers of the hand holding the support. Providing a fully enclosed opening for the fingers of the hand holding the support not only avoids the necessity of winding a line directly over the fingers but also provides a smoother bottom surface for the line to slide off the support.

With the hand thus positioned on the support the means used to fasten the free end of the tie to the support can be left exposed. The end of the support opposite the hanging means is preferably used to fix one end of a line on the support, preferably in a notch, before beginning to wind the line around the support. Preferably the ends of the support are tapered so they are larger in circumference where they attach to the handhold section and narrow as they extend away from the handhold section. The ends can also be separate pieces that attach to the center section to provide more versatility to accommodate different sized lines to be wound and stored on the same handhold section.

The word "cleat" as used in this specification does not refer to the common wedge or anvil shaped piece fastened to and projecting from the top surface of a supporting structure like a boat or dock but to the less common jamming cleat type that includes a cavity instead of projecting from the top surface. A jamming cleat also provides a non-directional means for securing the loose end of the tie in place by the simple expedient of press fitting the loose end of the tie securely into the cleat. One example of such means would be a V- or narrow U-shaped cavity with narrow parallel ridges on the walls of the cavity such as those described in U.S. Pat. No. 4,361,938 and the present specification. When a tie is pressed into such means the ridges also provide more friction to hold the tie in place.

As used in this specification the word "tie" means any elongate flexible object that can be affixed at one end to the center portion of the support, wrapped around a line attached to the support and thereafter secured by the loose end to a cleat from either direction. An elastic tie is preferred because it wears better by fitting more easily into and out of the cleat when stretched and also stays more securely in the cleat when it expands.

Thus when winding the line on the support, the hand holding the support using the indentations is turned in a more counterclockwise direction to facilitate winding the line more securely on the support. Tapering to narrow the ends of the support as they extend away from the wider center section also facilitates both initially pulling a looped or notched end of the line toward the center of the support before beginning to wind the line on the support and later when releasing the line by pulling the support and the line apart through the openings in the figure-8.

Using the preferred embodiment of the invention, the hanging end of the support can be grasped in one hand while the free hand releases the tie from the cleat, unwinds and drops the tie, then moves over the wound line. The hands press in opposite directions to separate the line from the support through the openings in the figure-8 and allow the line to drop off the support. The fully enclosed handhold makes it easier to slide the line over the smooth surfaces on the top and bottom of the support and thereby allow the line to fall down in a completely untangled and knot free condition.

In summary the product of the present invention expressed broadly is a support for storing a line comprising a stick having a center section, a first end, a second end, an elongate flexible tie having a first end and a second end, and a cleat wherein the center section is adapted to serve as a handhold, the two ends of the stick extend horizontally in both directions away from the handhold and are adapted to enable a user to wind a line around the ends of the stick in a figure-8 configuration, the first end of the tie is affixed to the center section,
the cleat is located in the center section and
the free end of the tie is adapted to fit into the cleat after the tie is wrapped around both the center section and a line wound on the support.

LIST OF REFERENCE NUMERALS

Figures 1, 2, 3, 4, 5, 6:
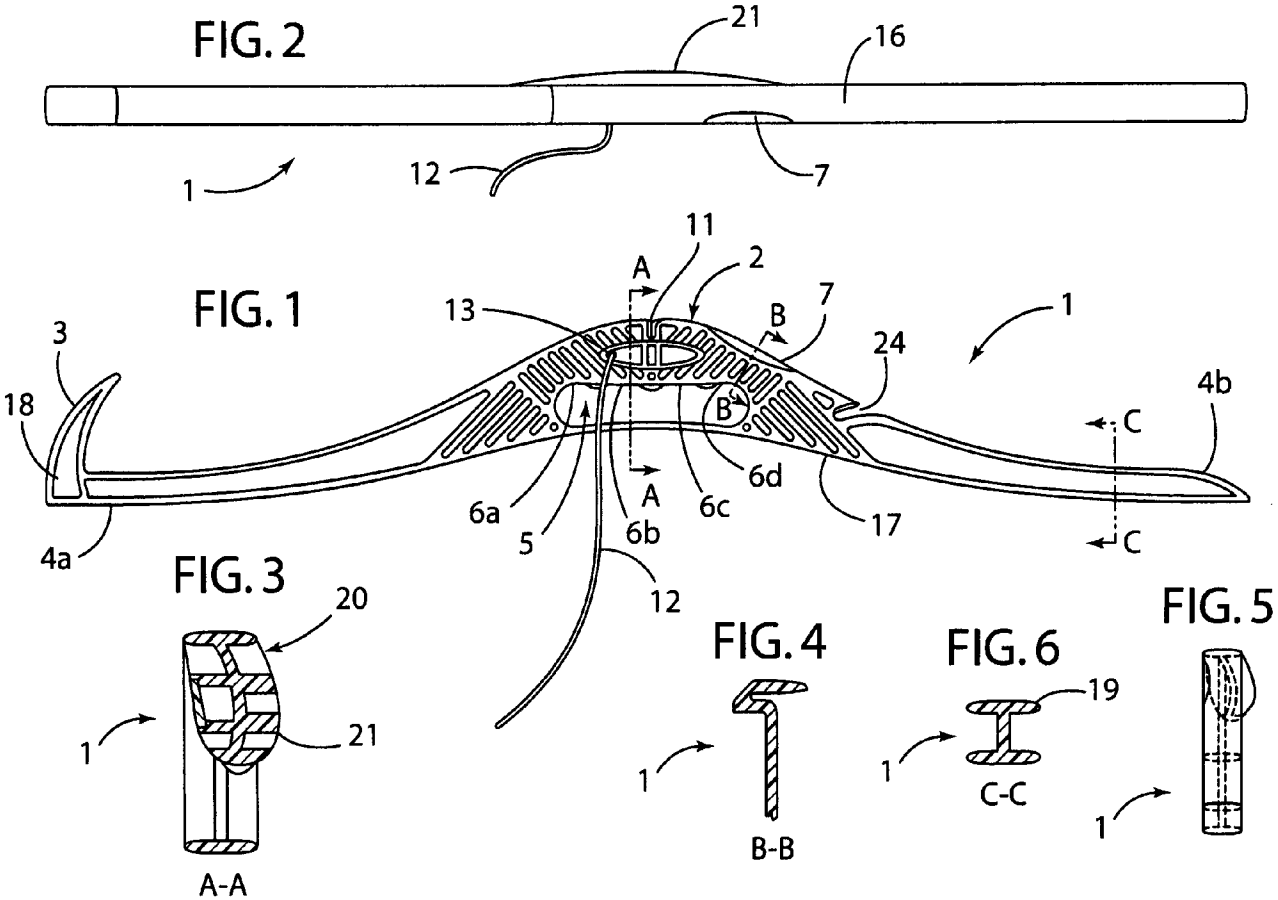
FIG. 1 is a front view of the support.
FIG. 2 is a top view of the support.
FIG. 3 a cross-section of the handhold at A-A.
FIG. 4 is a cross-section of a portion of the handhold.
FIG. 5 is a cross-section depicting a portion of the handhold that includes the thumb indentation.
FIG. 6 is a cross-section depicting the I-beam shape of the two ends of the support.

1 The support
2 The center section of the support
3 The hook on the first end of the support
4*a*,4*b* The first and second ends of the support
5 The handhold
6*a*, 6*b*, 6*c*, 6*d* The indentations for the fingers of the hand holding the support
7 The indentation for the thumb
8 A rope wound around the support
9 A string of lights wound around the support
10 A hand in position on the support
11 The cleat or fastening means for the free end of the tie
12 The tie
13 The fixed end of the tie
14 The loop at the end of a rope
15 The free end of the tie
16 Top surface of the support
17 Bottom surface of the support
18 Opening in hook end of support
19 I-beam shape of the ends of the support
20 Section of handhold
21 Outward bulge in handhold to facilitate the optimal positioning of hand on support
22 Bottom surface of support
23 The cutout for fastening one end of line before winding the line on the support
24 Notch
25 Hole through which the tie is threaded
26 Top portion of groove through which the tie can be stress fitted
27 Bottom portion of groove through which the tie can be stress fitted
28 Ridge to add further security to keep the tie in place once fitted into the groove
29 Recess into which the knotted end of the tie can be fitted to affix the tie to the support

DETAILED DESCRIPTION OF THE INVENTION

Best Mode for Carrying Out the Invention

FIG. 1 is a front view of a preferred embodiment of the support 1 showing the center section 2 of the support; the handhold 5 located in the center section 2; the indentations for the thumb 7 and fingers 6*a*, 6*b*, 6*c*, 6*d*; the hook 3 on the first end of the support 1; the two ends 4*a*,4*b* of the support 1; the opening 18 also for hanging the support 1; the tie 12 affixed at one end 13 to the center section 2 of the support 1; the bottom surface 17 of the support 1; the cleat 11 in the center section 2 of the support 1 and the notch 24 into which one end of the line (e.g., a loop on the end of a ski rope or a plug on the end of an electrical cord) can be fitted before winding a line on the support 1.

FIG. 2 is a view of the top 16 of the support 1 to show the tie 12, the outward bulge 21 in the handhold 5 and the indentation 7 for the thumb.

FIGS. 3, 4, 5 and 6 are cross sections to depict in greater detail the handhold 5, the thumb indentation 7 and the I-beam shape 19 of the ends.

Figure 7:
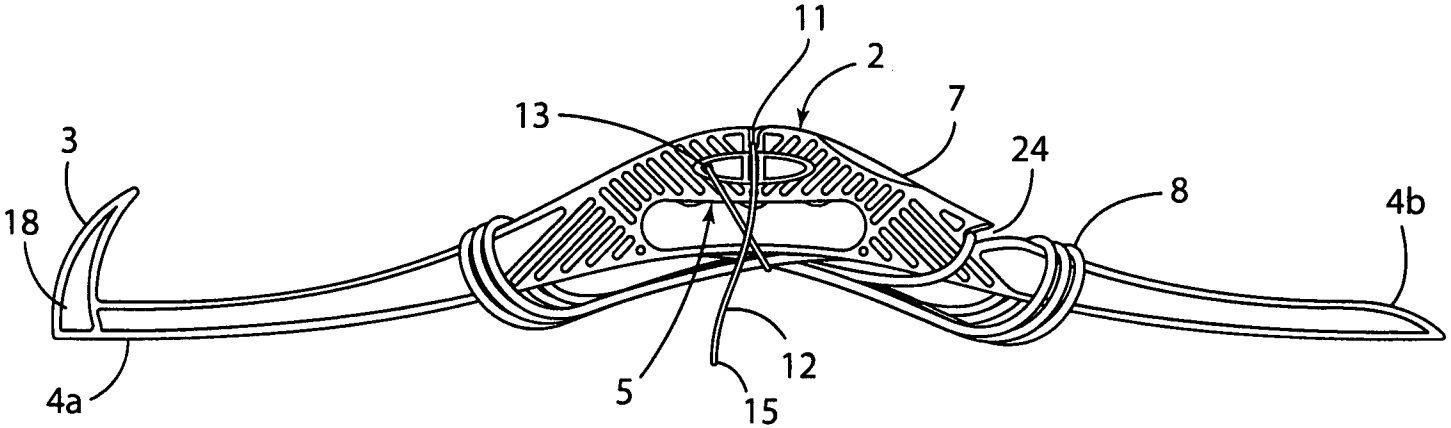
FIG. 7 is a front view of the support with a rope wound around the support and secured by the tie.
Figure 8:
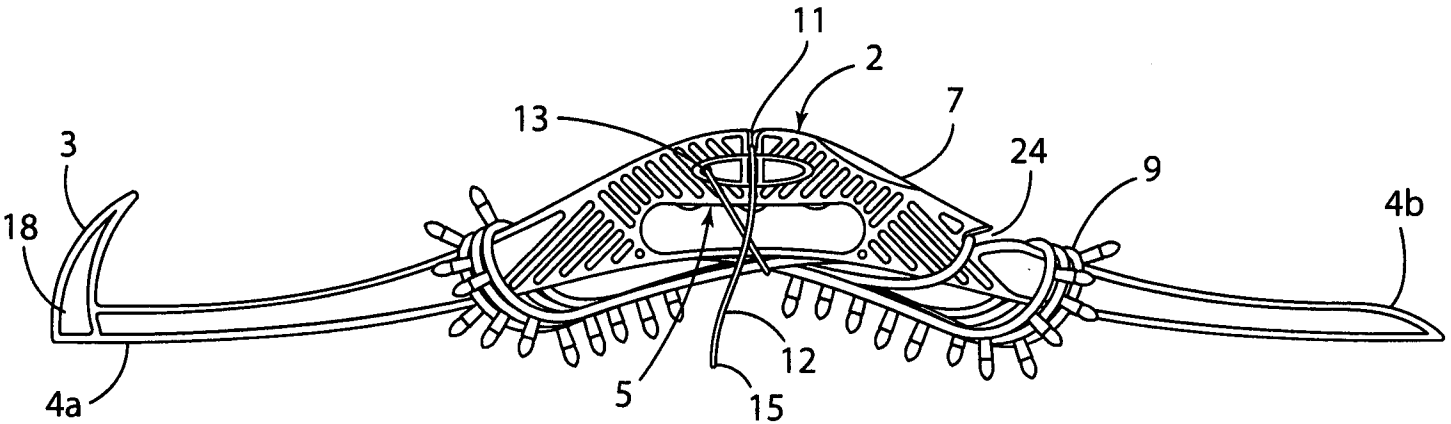
FIG. 8 is a front view of the support with a string of Christmas lights wound around the support in a figure-8 configuration.
Figure 11:
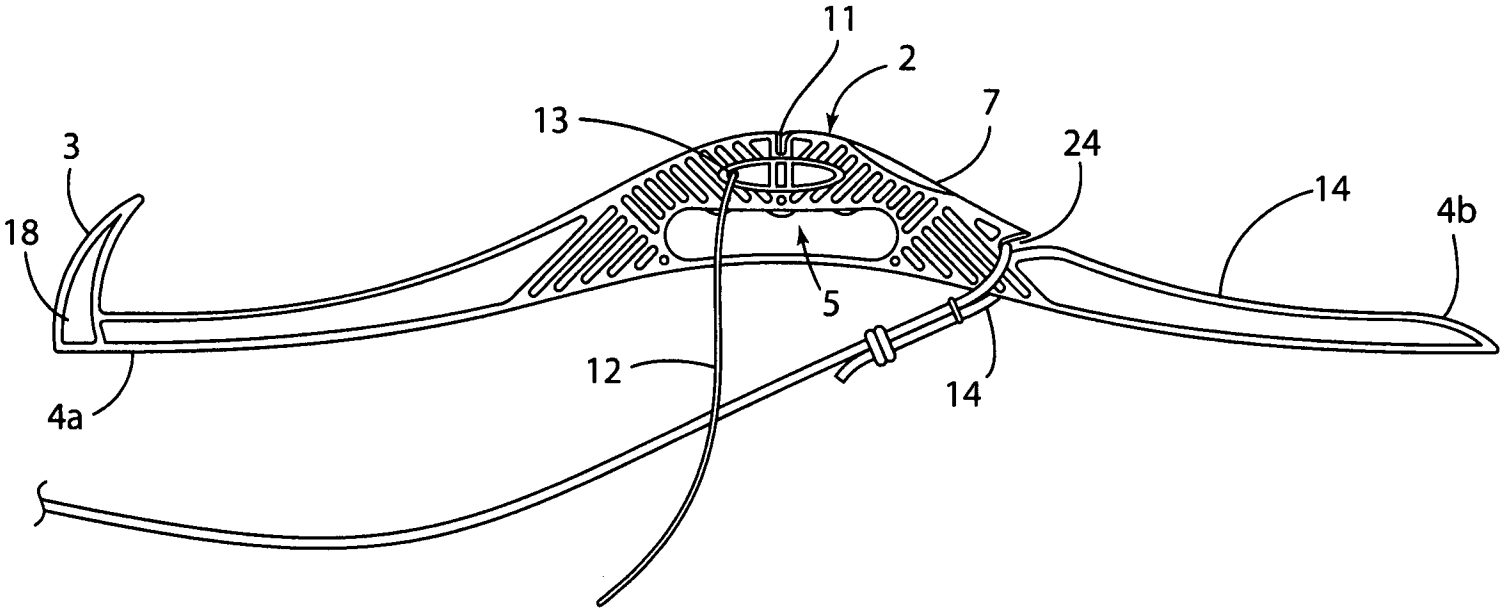
FIG. 11 depicts the looped end of a rope attached to one end of the support before winding a line on the support.

FIGS. 7 and 8 are views depicting a rope 8 and a string of Christmas tree lights 9 respectively wound around the support 1. These views taken together also display the following features of the support 1, the center section 2, the hook 3, the first and second ends 4*a*,4*b*, the handhold 5, the indentation for the thumb 7, the tie 12 affixed at one end 13 in the center section 2 and secured at the other end in the cleat 11, and an opening 18 in the hook 3 to provide additional means for hanging the support 1. FIG. 11, in addition to showing some of the above features discloses how the loop end of a rope 14 can fitted into the notch 24 on one end 4*b* of the support 1.

Figure 9:
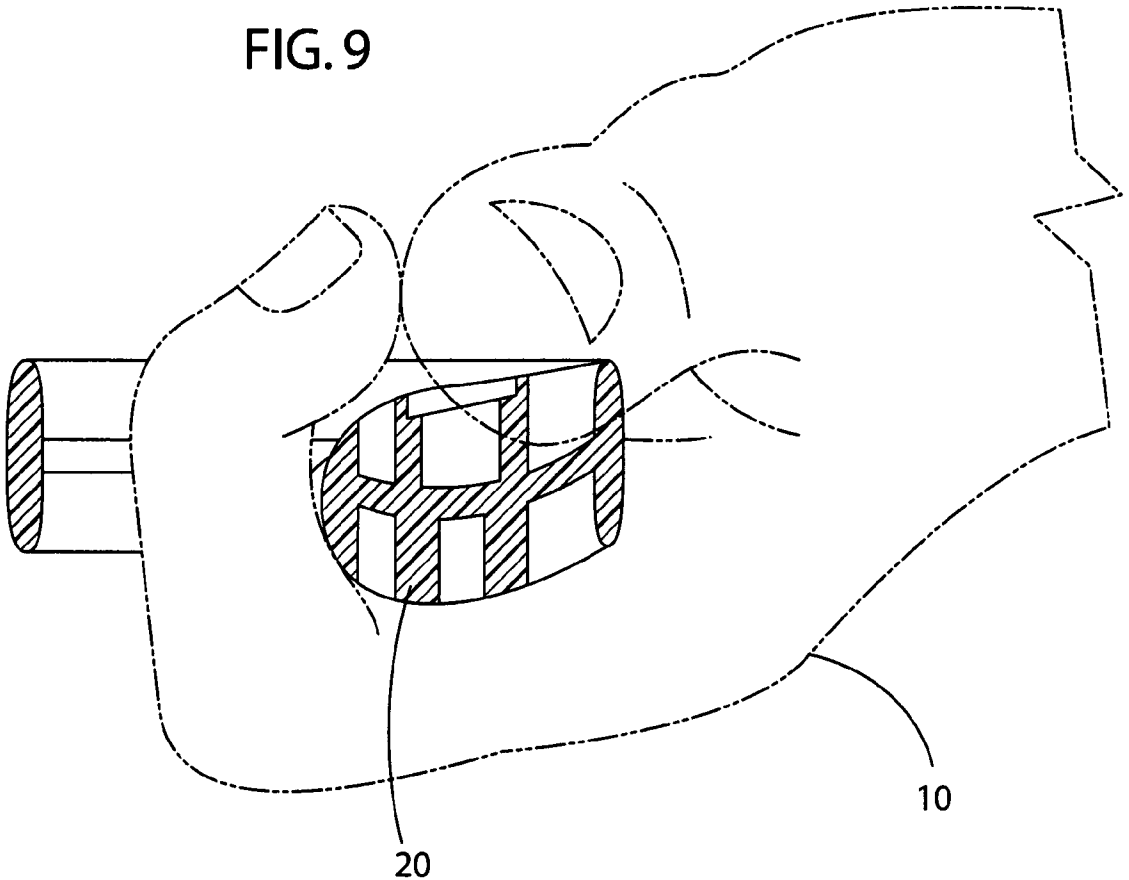
FIG. 9 is a cutout of the handhold accompanied by a hand holding the support.
Figure 10:
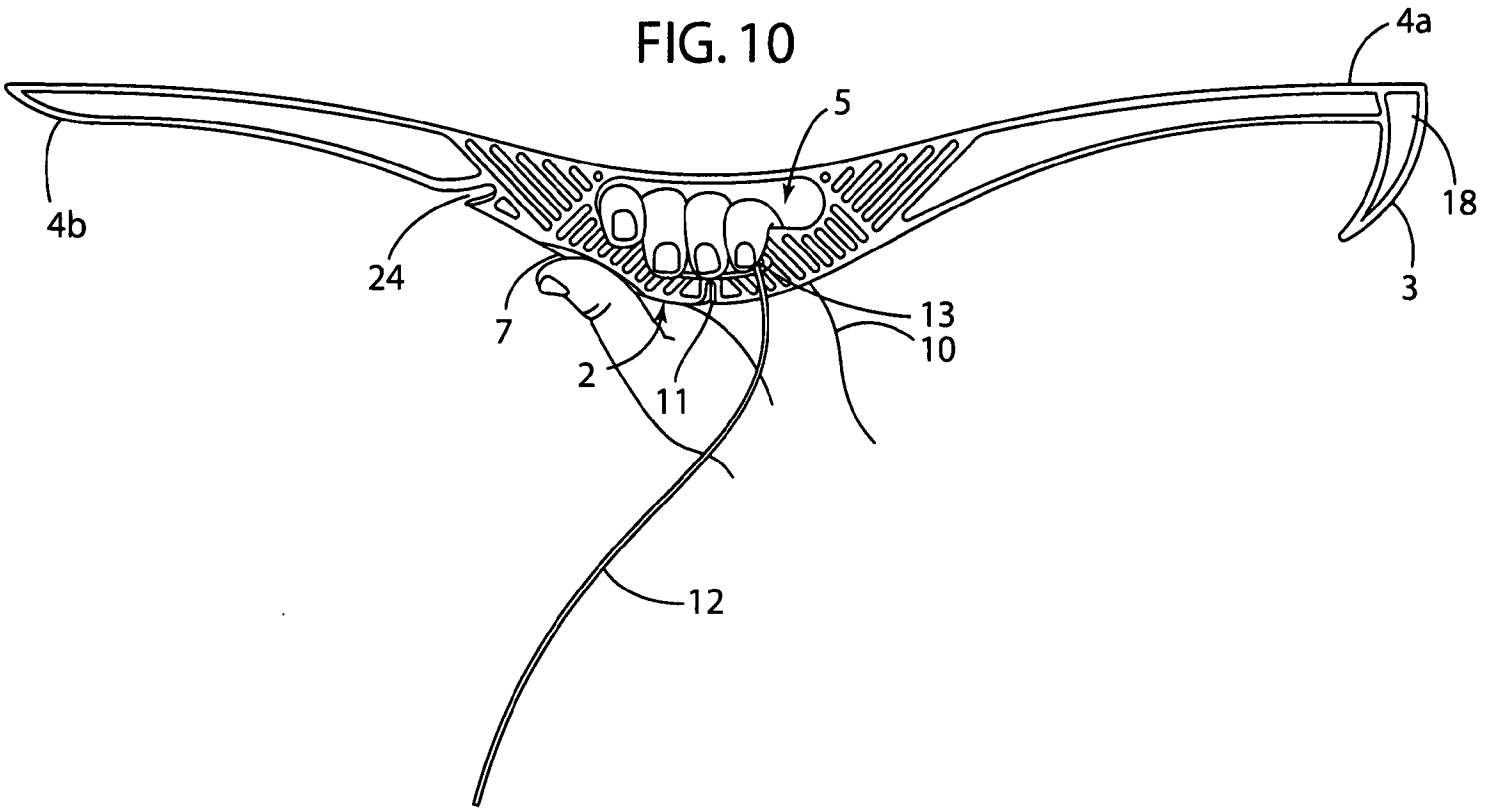
FIG. 10 depicts a hand holding the support preparatory to winding the line around the support.

FIGS. 9 and 10 provide two views to depict more clearly a hand 10 in position to hold the support 1 while leaving the cleat 11 exposed.

Figure 12:
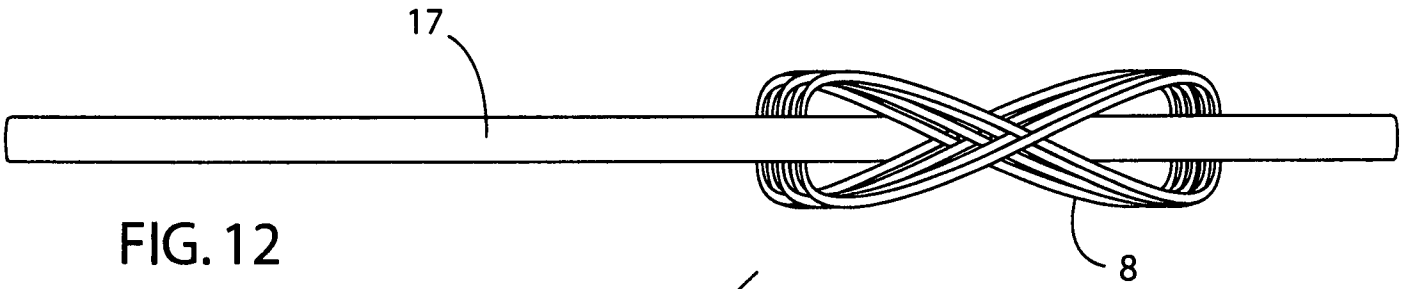
FIG. 12 provides a better perspective of the crisscross pattern formed by the figure-8.
Figure 13:
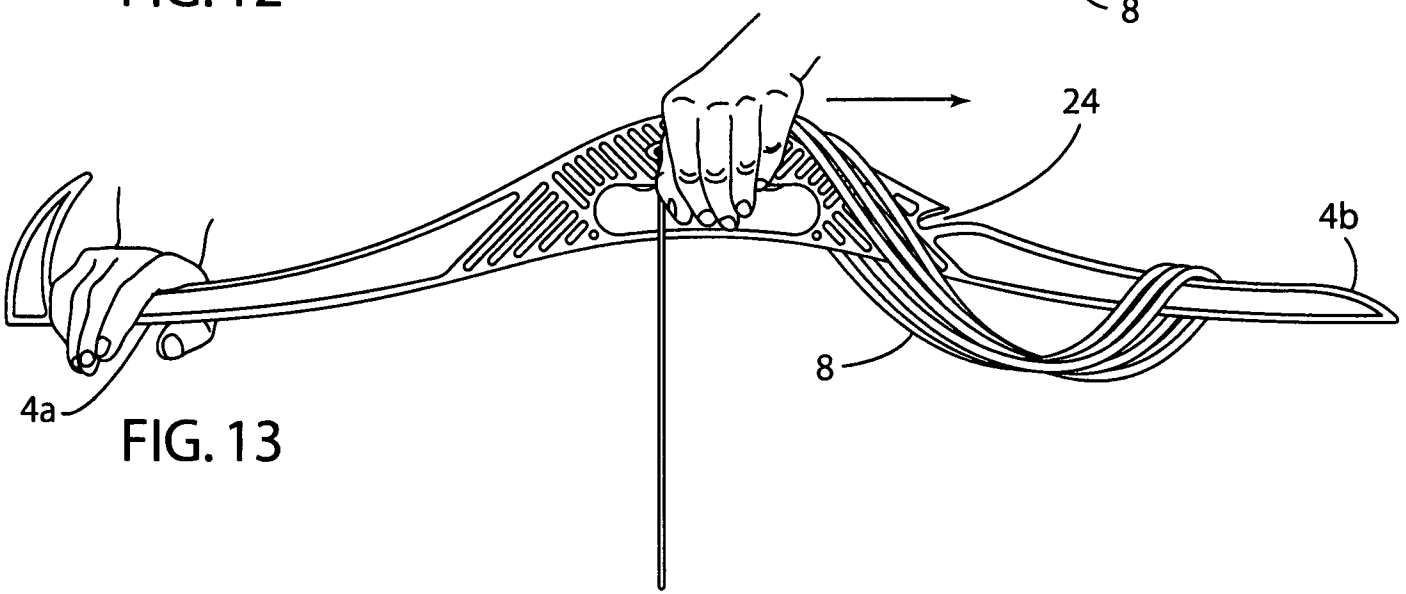
FIG. 13 depicts the way in which two hands work together to separate a rope from the support.

FIG. 12 provides a better view of the crisscross pattern formed by a rope 8 when fitted on the support 1. FIG. 13 provides a better view of the hands can be positioned on the support 1 and a rope 8 wound on the support to separate the rope 8 from the support 1.

Figure 14:
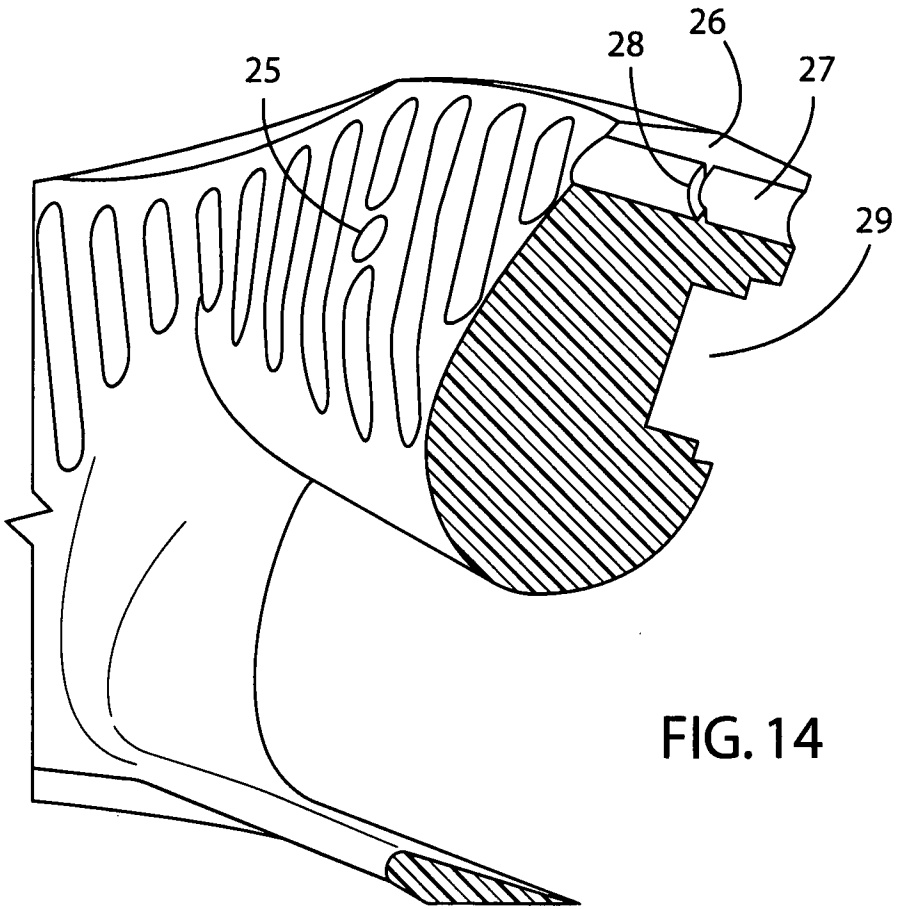
FIG. 14 is cross-section in perspective to show structural features of the cleat to accommodate the tie.

FIG. 14 is a cutout in cross section to provide a better view of the openings in the center section 2 of the support 1 to secure both ends of the tie 12 to the support 1. The free end 15 is threaded through hole 25 before affixing the other end 13, usually knotted, into the bottom of the recessed opening 29 on the back of the support 1. The top of recessed opening 29 is larger than the bottom to accommodate a cover (not shown) that doubles both to keep the fixed end of the tie 12 in place and to provide a place for a label for the support 1. The cleat 11 is essentially a cavity with a narrow opening or groove 26 at the top through which a stretched tie 12 can be fitted and a larger opening at the bottom where an expanded tie 12 can fit snugly. A horseshoe shaped ridge 28 at the bottom of the cavity parallel to the front surface of the support 1 can provide further resistance to accidental release of the tie 12.

The preferred embodiment of the present support 1 can be produced in one piece from a hard plastic material by a conventional molding process well known to those of ordinary skill in the molding art. A preferred plastic is polyoxymethylene polymer having a molecular formula of (CH2O)n, known for its high stiffness, low friction and excellent dimensional stability. It could be made of wood or metal but would probably be more expensive to produce and may not hold up as well under all conditions of use.

As an OEM product it is sized and fashioned to hold the particular line, most likely a cord or rope, to be wound and stored on the support by the manufacturer of the line. As a consumer product it would be produced in various sizes, for example, to accommodate the ropes, electrical cords or strings of Christmas tree lights in common use. For use on ropes used to tie boats to docks, it would be made large and strong enough to handle the larger size ropes used for that purpose. For ropes used by mountain climbers one end of the support 1 would preferably be fitted with a clasp or C-clip (not shown) for attachment to the equipment or belts used by climbers. To facilitate cooling without warping during the molding process the surface of the handhold 5 is ribbed and the rest of the support 1 is either hollow (not shown) or I-beam shaped 19.

The support 1 can be used to store the entire length of a line as well in the center portion of a line to shorten the line and thereby facilitate use of the line in a shortened condition where space is limited or crowded with other lines. Electrical cords are commonly longer than the length required to cover the distance between an appliance and the outlet to which it is connected. This is a more aggravating problem when multiple cords occupy the same space, for example behind computers, musical equipment or television screens and associated equipment.

A colorful cloth or plastic bag (not shown) can be used to package a string of Christmas lights wound around the support 1, as shown in FIG. 8. The hook end 3 of the support 1 can stick out from the top of the bag using a drawstring to tie the top of the bag to the support 1.

The method of the present invention for attaching a line to the support 1 is carried out by holding the support 1 with one hand at the handhold 5 in the center section, securing one end of a line either in the hand on the handhold or other available means (such as the notch 24) for securing the end of the line, winding the line around the ends 4*a*,4*b* of the support 1 in a figure-8 configuration with the other hand, wind the tie 12 around the center section 3 of the support 1 and the attached line and fitting the free end 15 of the tie 12 into the cleat 11. As shown in FIG. 13 the method of the present invention for releasing the line from the support 1 is carried out by holding the support 1 at the first end 4*a* with one hand, holding the line with the other hand, pulling the support 1 and the line apart out through the loops in the line and allowing the line to drop free of the support 1 in a knot and tangle free condition.

The foregoing provides both a general description of the present invention as well as a specific description of preferred embodiments. It should be understood that various substitutions, variations and modifications can be made by those skilled in the art without departing from the spirit and scope of the invention as further delineated in the following claims.

The invention claimed is:

1. A support for storing a line comprising a stick having a center section, a first end, a second end, an elongate flexible tie having a first end and a second end, and a cleat wherein the center section is adapted to serve as a handhold, the two ends of the stick extend horizontally in both directions away from the handhold and are adapted to enable a user to wind a line around the ends of the stick in a figure-8 configuration, the first end of the tie is affixed to the center section, the cleat is located in the center section and the free end of the tie is adapted to fit into the cleat after the tie is wrapped around both the center section and a line wound on the stick.

2. A support for winding and storing a line in a figure-8 configuration, the support having a center section, a top surface, a bottom surface, a first end and a second end comprising A handhold located in the center section of the support, the two ends of the support that extend out horizontally away from the center in opposite directions and have sufficient length to wind the line onto the support in the figure-eight configuration, An elastic tie having a first end, a second end and sufficient length to wrap around the line and the support when the line is wound around the ends of the support, the first end of the tie affixed to the center section of the support, and A jamming cleat located in the top surface of the center section of the support, the cleat adapted to secure the second end of the tie after the tie is wound around the line wound on the support.

3. The support of claim 2 further comprising an opening in the center of the support adapted to accommodate and fully encircle fingers of a hand gripping the support with the top surface of the support rounded in a shallow convex configuration and the bottom surface of the support rounded in a shallow concave configuration from the center section out toward the two ends of the support.

4. The support of claim 3 further comprising indentations in the opening adapted to accommodate four fingers of a hand holding the support and an indentation on the top surface of the support adapted to accommodate the thumb of the hand holding the support, the indentations positioned to place a hand holding the support in a favorable position both for winding the line on the support and securing the line to the support with the tie.

5. The support of claim 4 further comprising a support that is narrow and smooth enough from the top surface to the bottom surface in the center of the support to allow the support to slide through openings in the line wound around the ends of the support and yet wide enough from the top surface to the bottom surface in the center of the support to provide room for the opening for the fingers of the hand holding the support.

6. The support of claim 2 further comprising hanging means at one of the ends and the ends taper to narrow from the top surface to the bottom surface as they extend away from the center of the support.

7. The support of claim 6 wherein the hanging means consisting of a hook, an eye, a C-clip and/or a clasp.

8. The support of claim 2 further comprising the line wound around the ends of the support in a figure-8 configuration with the tie wrapped around the line and the second end of the tie is secured in the cleat.

9. The support of claim 8 wherein the line comprises a rope wound around the ends of the support.

10. The support of claim 8 wherein the line comprises a cord wound around the ends of the support.

11. The support of claim 8 wherein the line comprises a string of lights on an electrical cord wound around the support and enclosed in a cloth or plastic bag with a hook end of the support protruding from the top of the bag.

12. The support of claim 2 wherein the jamming cleat comprises a cavity having a top and a bottom wherein the top is a narrow groove that is wide enough to accommodate the tie when stretched and a larger groove on the bottom that is narrow enough to hold the tie in place when relaxed and at least one ridge on the inside surface at the bottom of the cavity to more firmly hold the tie in place.

13. The support of claim 2 further comprising a U-shaped notch having an open end, a closed end and two inside surfaces in the top surface on one side of the center section of the support to provide a place where one end of the line can be fitted before winding the line on the support wherein a. the notch is slanted so the open end is closer to one of the ends of the support than the closed end of the notch and b. an inside surface of the notch closest to the end of the support is curved in a shallow arc toward the end of the support as that surface approaches the top surface of the support so the line can slide off the support without catching.

14. The method of winding and securing a line in a figure-8 configuration by a person having a first hand and a second hand, on a support having a center section, a first end and a second end, the support comprising A handhold located in the center section of the support, the Two ends of the support that extend out horizontally away from the center in opposite directions and have sufficient length to wind the line to the support in a figure-eight configuration, An elastic tie having a first end, a second end and sufficient length to wrap around the line and the support when the line is wound around the ends of the support, the first end of the tie affixed to the center section of the support, and A jamming cleat located in the top surface of the center section of the support, the cleat adapted to secure the second end of the tie after the tie is wound around the line, The method comprising holding the handhold and one end of the line with the first hand and winding the line around the ends of the support in a figure-8 configuration with the second hand, winding the tie around the support and the line and fitting the second end of the tie into the cleat.

15. The method in accord with claim 14 further comprising the step of releasing the line on the support by holding the first end of the support with the first hand and, with the second hand, releasing the tie from the cleat, unwinding the tie, and holding the line wound on the support with the second hand and using both hands pulling the support and the line apart through loops in the figure-8 and allowing the line to drop free from the support in a knot and tangle free condition.

16. The method of claim 14 further comprising the step of attaching one end of the line to a notch in the top surface of the support instead of holding the line in the first hand holding the support before winding the line on the support.

* * * * *